United States Patent [19]

Evans

[11] Patent Number: 4,934,060

[45] Date of Patent: Jun. 19, 1990

[54] GOLFER'S AID

[76] Inventor: Paul L. Evans, 1105 Monaco Pkwy., Denver, Colo. 80220

[21] Appl. No.: 390,742

[22] Filed: Aug. 8, 1989

[51] Int. Cl.[5] ..... G01C 15/10

[52] U.S. Cl. ..... 33/393; 273/32 H

[58] Field of Search ..... 33/393, 394, 392, 508, 33/283; 273/32 H

[56] References Cited

U.S. PATENT DOCUMENTS

| | | | |
|---|---|---|---|
| 2,136,072 | 11/1938 | Bush . | |
| 3,242,582 | 3/1966 | Garrett . | |
| 3,309,089 | 3/1967 | Doyle | 273/32 |
| 3,478,438 | 11/1969 | Lazar | 33/394 |
| 4,260,151 | 4/1981 | Weaver | 273/32 H |
| 4,459,761 | 7/1984 | Bosco | 33/393 |

FOREIGN PATENT DOCUMENTS

| | | | |
|---|---|---|---|
| 0882595 | 11/1961 | United Kingdom | 33/393 |

*Primary Examiner*—William A. Cuchlinski, Jr.
*Assistant Examiner*—William C. Dowling
*Attorney, Agent, or Firm*—Brian D. Smith

[57] ABSTRACT

A golfer's aid for helping a golfer determine the contour of a putting green and a method of assembling the golfer's aid are disclosed. The aid includes a plumb bob and a plumb line having a first end secured to the plumb bob and a second end secured to a cylindrical shaft which is mounted in a golf ball shaped casing. The casing has a first hemispherical half and a second hemispherical half which are snapped together to form the casing. When snapped together, the first and second hemispherical halves define a chamber for housing the plumb bob. The walls of the chamber, in turn, define an inner bore for receiving the plumb line and an outer bore for receiving the plumb bob. The first half of the casing also defines a round hole for rotatably receiving a first end of the shaft. The second half of the casing is provided with a shaft retaining ring for rotatably receiving the other end of the shaft. The retaining ring and the round hole oppose one another to that the longitudinal axis of the shaft is aligned with the axis of the casing when the shaft is mounted in the casing. The shaft further includes a retaining collar mounted on the shaft at a location adjacent the shaft's first end. The collar abuts up against that portion of the interior surface of the second half which surrounds the round hole. As such, the second end of the shaft is prevented from slipping out of the retaining ring.

10 Claims, 2 Drawing Sheets

GOLFER'S AID

TECHNICAL FIELD

The invention relates generally to golfing and, more particularly, to a device for helping a golfer line up a putt on a putting green.

BACKGROUND OF THE INVENTION

U.S. Pat. No. 3,309,089 to R. V. Doyle discloses a golfer's aid which may be used as a plumb bob by the golfer to help a golfer determine the contour of a putting green. The aid includes a pocket-watch shaped case, a spring loaded winding drum mounted inside the case, a nylon plumb line attached at one end thereof to the winding drum and a knurled knob which is screwed into the case and attached to the other end of the plumb line.

To determine the contour of a putting green with Doyle's aid, one must first unscrew the knob from the case and then pull on the knob to unwind the plumb line from the winding drum. The knob is then held in one hand and the case is allowed to freely dangle from the knob. As such, the case serves as a plumb bob to find true verticality, thereby helping the golfer determine the contour of the green.

Other patents disclosing plumb bob apparatus include U.S. Pat. Nos. 3,242,582 and 2,136,072.

While Doyle's aid undoubtedly works as intended, it is somewhat difficult to use in that the knob must first be unscrewed from the case and then pulled out of the case to unwind the plumb line. In addition, after using the aid to determine the contour of a putting green, the knob of Doyle's aid must be screwed back into the case. Accordingly, it would be desirable if a device for helping a golfer determine the contour of a putting green were available that is easier to use than that disclosed in Doyle. It would also be desirable if such an aid were inexpensive and easy to assemble.

SUMMARY OF THE INVENTION

The present invention provides a golfer's aid for determining the contour of a putting green which is both easy to use and assemble. The aid includes a hollow, generally spherical casing having an interior surface and a dimpled exterior surface wherein the dimples are sized and configured to create the appearance of a golf ball. The spherical casing has a first hemispherical half and a second hemispherical half, both of which include means for securing, preferably snapping, the halves together so that the secured halves form the spherical casing.

The first hemispherical half also includes a first chamber portion which defines part of a chamber for housing a plumb bob. The second hemispherical half includes a second chamber portion which defines the remaining portion of the chamber for housing the plumb bob. The first and second chamber portions define the chamber when the first and second hemispherical halves are secured together.

The first and second chamber portions, in turn, define an inner bore for receiving a plumb line when the first and second hemispherical halves of the casing are secured together. In addition, the first and second chamber portions define an outer bore for permitting the passage of the plumb bob into and out of chamber. As with the inner bore, the outer bore is defined when the first and second hemispherical halves are secured together. In addition, the inner bore is located with respect to the outer bore so that the inner bore is axially aligned with and located between the outer bore and the geometric center of the casing.

The first hemispherical half of the casing also defines a round hole extending through the casing for receiving the first end of a cylindrical winding shaft. The round hole is sized to permit the shaft to rotate therein. In addition, the aforementioned second hemispherical half has a shaft retaining ring located on its interior surface. The shaft retaining ring receives the second end of the shaft and the shaft retaining ring is sized to permit the shaft's second end to rotate therein. The retaining ring is located on the second hemispherical half so as to generally oppose the round hole of the first half so that the longitudinal axis of the shaft is aligned with the axis of the casing when the shaft is mounted in the casing. The shaft is mounted in the casing when (1) the shaft's second end is disposed in the retaining ring, (2) the shaft's first end projects out through the round hole, and (3) the first and second hemispherical halves are secured together to form the casing.

The cylindrical shaft further includes a retaining collar located on the shaft at a location adjacent the shaft's first end. The retaining collar is located on the shaft so as to abut up against the portion of the interior surface of the second hemispherical half which surrounds the round hole. The retaining collar maintains the shaft in axial alignment with the casing by preventing the second end of the shaft from slipping out of the retaining ring.

The aforementioned plumb line has a first end which is secured to the plumb bob and a second end which is secured to a plumb line securing means such as a knob which projects outwardly from a point on the midsection of the shaft.

A preferred embodiment of the present invention also includes plumb line guide means located on the shaft for preventing the plumb line from tangling during rewinding. The guide means prevents such tangling by guiding or directing the plumb line during rewinding so that the plumb line winds or rewinds about a central portion of the shaft which includes the line securing means.

To use the golfer's aid of the present invention to determine the contour of a putting green, one simply holds the golf ball shaped casing in one hand and allows the plumb bob located in the chamber to fall out of the chamber under the action of gravity. The falling action of the plumb bob unwinds the plumb line which is wrapped about the cylindrical shaft. When the plumb line is completely unwound, the plumb bob will be suspended from the casing which is held in one hand by the golfer. The golfer then simply uses the aid to determine the contour of a putting green as one would use a conventional plumb bob to determine the verticality of an object.

Those skilled in the relevant art will also appreciate the ease with which the aforementioned golfer's aid is assembled. Accordingly, the present invention additionally provides a method of assembling the golfer's aid of the present invention.

The assembly method includes attaching the first end of the plumb line to the plumb bob and the second end of the plumb line to the plumb line securing means located on the cylindrical shaft. The first end of the cylindrical shaft is inserted into the round hole of the first hemispherical half until the retaining collar of the shaft abuts up against the interior surface of the second hemispherical half. Similarly, the second end of the cylindrical shaft is inserted into the shaft retaining ring of the second hemispherical shaft.

After inserting the shaft as stated above and attaching the plumb line to the shaft, the plumb line is then preferably arranged so that it is located in those portions of either the first chamber portion or the second chamber portion which define the inner and outer bores. The plumb line is also arranged so that its first end which is attached to the plumb bob is located outside the casing. With the plumb line so arranged, the first and second hemispherical halves are pressed together so that the respective securing means of the halves snap together to secure the halves together, thereby forming the golf ball shaped casing.

As such, it will appreciated that the shaft is now mounted in the casing. It will also be appreciated that the plumb line extends in an unwound fashion through the inner and outer bores with one end thereof attached to the shaft and the other end attached to the plumb bob which is located outside the casing. Accordingly, at this point, it will generally be desirable to wind the plumb line about the shaft. To do so, one simply grasps the first end of the shaft projecting out of the round hole and rotates it. This action rotates the shaft which, in turn, winds the plumb line about the shaft. The shaft is rotated until the plumb line is completely wound about the shaft and the plumb bob is located in the chamber.

BRIEF DESCRIPTION OF THE DRAWINGS

Other features of this invention will appear in the following description and appended claims, reference being made to the accompanying drawings forming a part of the specification where like referenced characters designate corresponding parts in the views.

DETAILED DESCRIPTION OF THE DRAWINGS

Figure 1:
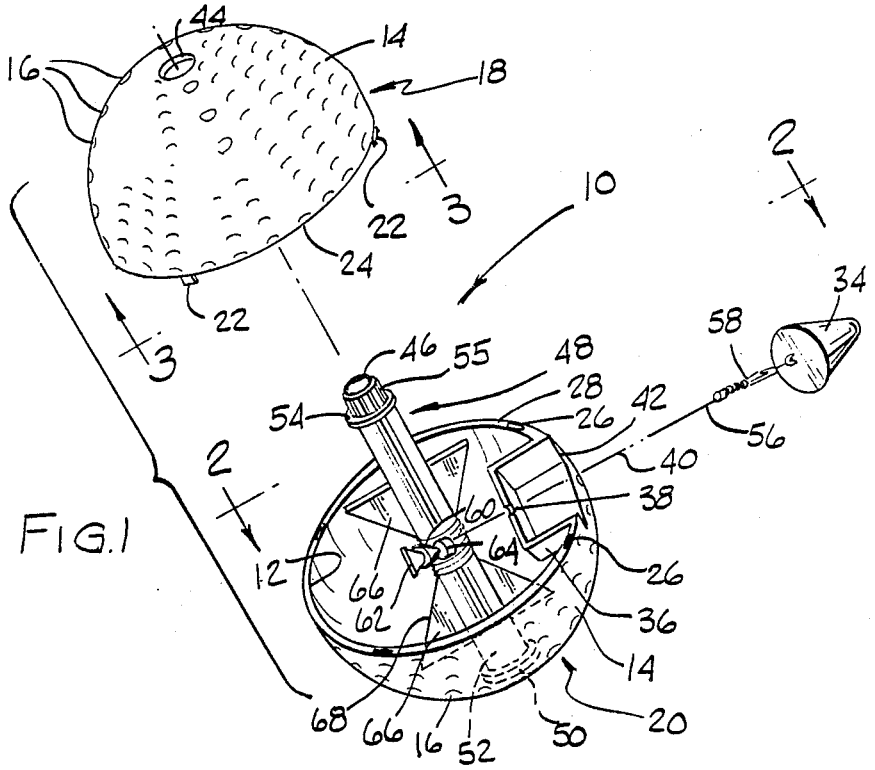
FIG. 1 is an exploded, perspective view of a golfing aid of the present invention.

FIGS. 1 through 4 illustrate a golfer's aid 10 of the present invention for determining the contour of a putting green. As will be seen, aid 10 is both easy to use and assemble.

Aid 10 includes a hollow, generally spherical casing (not numbered) which has an interior surface 12 and a dimpled exterior surface 14. Exterior surface 14 is provided with dimples 16 which are sized and configured to give the casing the appearance of a golf ball.

The casing consists of essentially two parts, a first hemispherical half 18 and a second hemispherical half 20, both of which are preferably made by an injection molding process. Halves 18 and 20 are secured together to form the casing by securing means which essentially snap the two halves together. The securing means includes four first securing means 22 (also referred to herein as male snap portions 22) which are spaced equally from each other on an edge 24 of the first half and four second securing means (also referred to herein as female snap portions 26) which are spaced equally from each other and located on an edge 28 of the second half. Male portions 22 and female portions 26 are aligned with respect to each other and sized so that they snap together to thereby secure the halves together, thereby forming the spherical casing.

First hemispherical half 18 also includes a first chamber portion 30 which defines part of a chamber 32 for housing a plumb bob 34 which, as is explained below, is employed to determine the contour of a putting green. Similarly, second hemispherical half 20 includes a second chamber portion 36 which defines the remaining portion of chamber 32 for housing plumb bob 34. First and second chamber portions define chamber 32 when the first and second hemispherical halves are secured together.

Turning now to the first and second chamber portions 30, 36, it can be seen in the drawings that chamber portions 30, 36 define an inner bore 38 for receiving a plumb line 40 and an outer bore 42 which is sized to permit plumb bob 34 to pass into and out of chamber 32. As will be appreciated, inner bore 38 and outer bore 42 are defined when the first and second hemispherical halves are snapped together. It will also be appreciated that inner bore 38 is located with respect to outer bore 42 so that the inner bore is axially aligned with and located between the outer bore and the geometric center of the casing.

First hemispherical halve 18 also defines a round hole 44 extending through the casing for receiving a first end 46 of a cylindrical winding shaft 48. Round hole 44 is sized to permit rotation of shaft 48. In addition, second hemispherical half 20 has a shaft retaining ring 50 located on its interior surface 12. Retaining ring 50 receives a second end 52 of shaft 42 and retaining ring 52 is also sized to permit rotation of second end 52. Retaining ring 50 is further located on half 20 so as to oppose round hole 44 of the first half so that the longitudinal axis of shaft 48 will be aligned with the axis of the casing when the shaft is mounted in the casing. Shaft 48 is mounted in the casing when (1) second end 52 is disposed in retaining ring 50, (2) first end 46 projects out through round hole 44 and (3) the first and second halves 18 and 20 are secured together or snapped together to form the casing.

Figure 4:
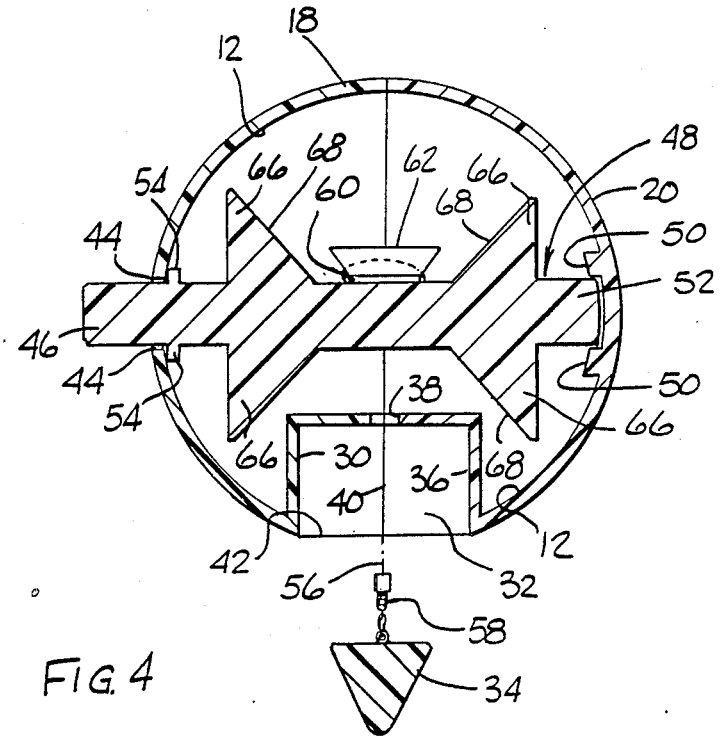
FIG. 4 is a cross-sectional view taken along Lines 4—4 of FIG. 2 which is accurate except that the view is shown as it would appear with the right and left halves of the golfing aid snapped together.

Turning now to the details of shaft 48 which is also preferably injection molded, it can be seen in Figs. 1 and 4 that shaft 48 is provided with a retaining collar 54 which is located on the shaft at a location adjacent the shaft's first end 46. Retaining collar is located so as to abut up against that portion of interior surface 12 which surrounds round hole 44. As such, collar 54 maintains the shaft in axial alignment with the casing by preventing second end 52 of the shaft from slipping out of retaining ring 50. Accordingly, retaining collar 54 keeps shaft 48 mounted in the casing when halves 18 and 22 are snapped together.

It will also be appreciated that first end 46 of shaft 48 (i.e., that portion of shaft 48 which projects outwardly from the casing through round hole 44) is provided with longitudinally extending grooves 55. Grooves 55 facilitate gripping of the first end which, in turn, facilitates rotation of the shaft as will be explained in more detail below.

Figure 2:
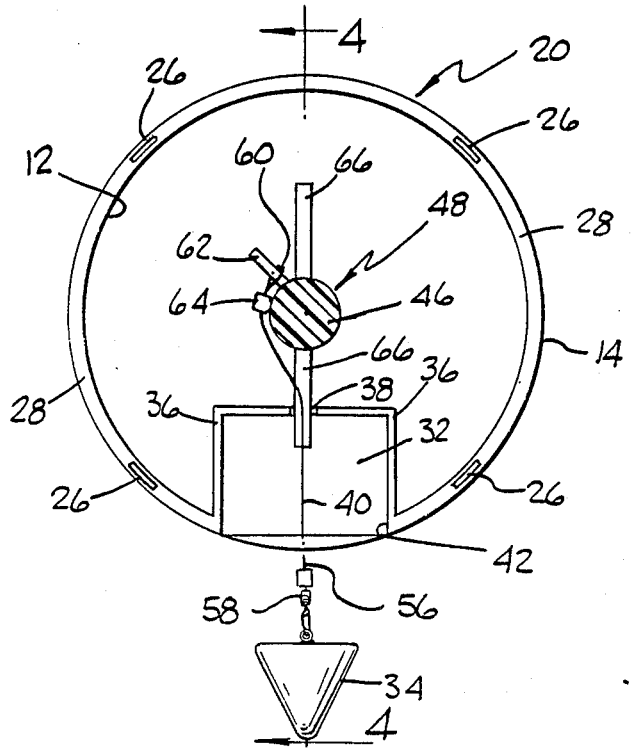
FIG. 2 is a cross-sectional view taken along Lines 2—2 of FIG. 1.
Figure 3:
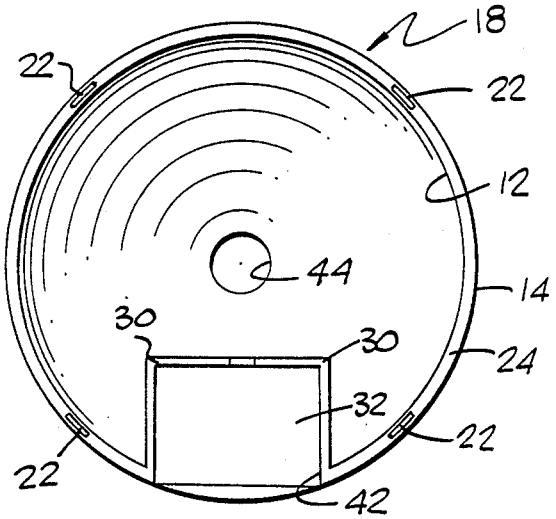
FIG. 3 is a cross-sectional view taken along Lines 3—3 of FIG. 1.

Turning now to plumb line 40, FIG. 2 best illustrates that a first end 56 of the plumb line is secured to plumb bob 34 by a swivel-type fastener 58. Swivel-type fastener 58 serves to prevent the plumb line from twisting relative to the plumb bob. The other end or second end 60 of plumb line 40 is looped as such is best illustrated in FIG. 1. As also illustrated in FIG. 1, looped end 60 is secured to shaft 48 by looping it over a semi-triangularly shaped knob or cleat 62 which projects outwardly from the midsection of shaft 48. Looped end 60 is created by forming a loop on the end of the plumb line and then crimping a collar 64 about the portions of the plumb line in contact with each other. As such, a permanent loop is formed on this end of the plumb line.

Returning now to shaft 48, it can be seen in the drawings that shaft 48 is also preferably provided with two pairs of triangularly shaped, fin-like projections 66 which are located on opposite sides of the shaft (i.e., they are spaced 180 degrees apart from one another). Each projection 66 projects outwardly from the shaft and is located either between the first end 46 of shaft 48 and knob 62 or between second end 52 of shaft 48 and knob 62. It will also be appreciated that the projections of each pair are spaced equally from knob 62. In addition, each projection defines a plumb line guide surface 68, as such is best illustrated in FIG. 4, which faces the central portion of the shaft and adjoins the cylindrical surface of the shaft at an angle of about 45 degrees. Guide surfaces 68 are designed to guide the plumb line to the center or midsection of the shaft (which includes knob 62) when the plumb line is being rewound about the shaft. This guiding serves to prevent the plumb line from tangling as it is being rewound.

To assemble aid 10 of the present invention in accordance with the assembly method of the present invention, one preferably starts by first attaching end 56 of the plumb line to plumb bob 34. End 52 of the plumb line is then attached to the shaft by looping it over knob 62 provided on shaft 48. End 46 of the shaft is then inserted into round hole 44 of the first half until retaining collar 54 abuts up against the interior surface of the first half. Similarly, second end 52 of the shaft is then preferably inserted into retaining ring 52 of the second hemispherical half.

Those skilled in the art will appreciate that halves 18 and 20 while not snapped together yet are now facing each other so that their respective edges 24 and 28 oppose one another. At this point, the plumb line should be arranged so that its located in those portions of either the first chamber portion or the second chamber portion which define the inner and outer bores. The plumb line should also be arranged so that its end which is attached to the plumb bob, i.e., end 56 is located outside the casing.

After arranging the plumb line as described, first and second halves 18 and 20 may then be pressed together so that securing means 22 and 26 of the respective halves snap together thereby securing the halves together to form the golf ball shaped casing. At this point, it will be appreciated that the shaft is now mounted in the casing as previously described. It will also be appreciated that the plumb line is extending in an unwound fashion through the inner and outer bores. Accordingly, at this point it will generally be desirable to wind the plumb line about the shaft. To do so, one simply grasps the grooved first end 46 of the shaft which projects out of round hole 44 and rotates it. The rotating action of the shaft causes the plumb line to wind about the shaft until the plumb bob is located in the chamber. The aid is now assembled.

To use aid 10 to determine the contour of a putting green, one simply holds the aid in one hand and allows the plumb bob located in chamber 32 to fall out of the chamber under the action of gravity. The falling action of the plumb bob unwinds the plumb line which is wrapped about the cylindrical shaft. When the plumb line is completely unwound, the plumb bob will be suspended from the casing which is held in one hand by the golfer. The golfer then simply uses the aid to determine the contour of the putting green as one would use a conventional plumb bob to determine the verticality of an object.

While the invention has been shown and described in detail herein, it should be understood that the invention is not to be limited to the exact form disclosed and changes in detail and construction with regard to the disclosed embodiment may be made without departing from the spirit of the invention.

What Is claimed:

1. A golfer's aid comprising:

a plumb bob;

a plumb line having a first end and a second end, said first end being secured to said plumb bob;

a cylindrical shaft having a first end for gripping, a second end and plumb line securing means attached to the midsection of said shaft for securing said second end of said plumb line to said shaft; and a hollow, generally spherical casing having an interior surface and a dimpled exterior surface wherein the dimples are sized and configured to create the appearance of a golf ball, said spherical casing including a first hemispherical half and a second hemispherical half, said first and second hemispherical halves including means for securing said halves together so that said secured halves form said spherical casing, said first hemispherical half also including a first chamber portion which defines part of a chamber for housing said plumb bob, said second hemispherical half including a second chamber portion which defines the remaining portion of said chamber for housing said plumb bob, said first and second chamber portions defining said chamber when said first and second hemispherical halves are secured together, each of said first and second chamber portions in turn defining portions of a inner bore for receiving said plumb line, said inner bore being defined when said first and second hemispherical halves are secured together, each of said first and second chamber portions also defining portions of a outer bore extending through said exterior surface of said casing, said outer bore permitting the passage of said plumb bob into and out of said chamber, said outer bore also being defined when said first and said second hemispherical halves are secured together, said inner and outer bores also be located with respect to each other and said chamber so that said inner bore is axially aligned with and located between said outer bore and the geometric center of said casing, said first hemispherical half of said casing also defining a round hole extending through said casing, said round hole receiving said first end of said shaft and being sized to permit said shaft to rotate therein, said second hemispherical half having a shaft retaining ring located on its interior surface, said shaft retaining ring receiving said second end of said shaft and being sized to permit said second end to rotate therein, said retaining ring being located on said second hemispherical half so as to generally oppose said round hole extending through said first hemispherical half so that the longitudinal axis of said shaft is aligned with the axis of said casing when said shaft is mounted in said casing, said shaft being mounted in said casing when (1) said second end is disposed in said retaining ring, (2) said first end is located in and projecting out through said round hole, and (3) said first and second hemispherical halves are secured together to form said casing; and said shaft further including a retaining collar mounted on said shaft at a location adjacent said first end, said retaining collar being located on said shaft so as to abut up against the portion of said interior surface of said second hemispherical half which surrounds said round hole, said retaining collar maintaining said shaft in axial alignment with said casing by preventing said second end of said shaft from slipping out of said retaining ring.

2. A golfer's aid as claimed in claim 1 wherein said shaft further includes guide means for preventing said plumb line from tangling during rewinding, said guide means preventing such tangling by guiding said plumb line to a central portion of said shaft as said shaft is being rotated to rewind said plumb line.

3. A golfer's aid comprising:

a plumb bob;

a plumb line having a first end and a second looped end, said first end being secured to said plumb bob;

a cylindrical shaft having a first end for gripping, a second end and a knob projecting outwardly from a point on the midsection of said shaft, said knob being sized and configured so that said first looped end of said plumb line is looped over said knob and secured thereto;

a hollow, generally spherical casing having an interior surface and a dimpled exterior surface wherein the dimples are sized and configured to create the appearance of a golf ball, said spherical casing including a first hemispherical half and a second hemispherical half, said first and second hemispherical halves including means for securing said halves together so that said secured halves form said spherical casing, said first hemispherical half also including a first chamber portion which defines part of a chamber for housing said plumb bob, said second hemispherical half including a second chamber portion which defines the remaining portion of said chamber for housing said plumb bob, said first and second chamber portions defining said chamber when said first and second hemispherical halves are secured together, each of said first and second chamber portions in turn defining portions of a inner bore for receiving said plumb line, said inner bore being defined when said first and second hemispherical halves are secured together, each of said first and second chamber portions also defining portions of a outer bore extending through said exterior surface of said casing, said outer bore permitting the passage of said plumb bob into and out of said chamber, said outer bore also being defined when said first and said second hemispherical halves are secured together, said inner and outer bores also be located with respect to each other and said chamber so that said inner bore is axially aligned with and located between said outer bore and the geometric center of said casing, said first hemispherical half of said casing also defining a round hole extending through said casing, said round hole receiving said first end of said shaft and being sized to permit said shaft to rotate therein, said second hemispherical half having a shaft retaining ring located on its interior surface, said shaft retaining ring receiving said second end of said shaft and being sized to permit said second end to rotate therein, said retaining ring being located on said second hemispherical half so as to generally oppose said round hole extending through said first hemispherical half so that the longitudinal axis of said shaft is aligned with the axis of said casing when said shaft is mounted in said casing, said shaft being mounted in said casing when (1) said second end is disposed in said retaining ring, (2) said first end is located in and projecting out through said round hole, and (3) said first and second hemispherical halves are secured together to form said casing; and said shaft further including a retaining collar mounted on said shaft at a location adjacent said first end, said retaining collar being located on said shaft so as to abut up against the portion of said interior surface of said second hemispherical half which surrounds said round hole, said retaining collar maintaining said shaft in axial alignment with said casing by preventing said second end of said shaft from slipping out of said retaining ring.

4. A golfer's aid as claimed in claim 3 wherein said shaft has at least one pair of projections projecting outwardly from said shaft and wherein each pair of projections includes a first projection located between said first end and said knob and a second projection located between said second end and said knob, said first and second projections also being spaced equally from said knob, said projections further being sized and configured to guide said plumb line to a central portion of said shaft which includes said knob when said shaft is being rotated to rewind said plumb line which, in turn, returns said plumb bob to said chamber, the guiding of said plumb line provided by said projections serving to prevent said plumb line from tangling during rewinding.

5. A golfer's aid as claimed in claim 4 wherein said shaft is provided with two of said pairs of said projections, said pairs being located on opposite sides of said shaft so that they are spaced 180 degrees apart from one another.

6. A golfer's aid as claimed in claim 4 wherein each projection defines a plumb line guide surface which faces the central portion of said shaft and adjoins the cylindrical surface of said shaft at an angle of about 45 degrees.

7. A golfer's aid as claimed in claim 3 wherein said first end of said shaft which projects outwardly from said casing through said round hole is provided with longitudinally extending grooves for facilitating gripping of said first end to facilitate rotation of said shaft.

8. A golfer's aid as claimed in claim 3 further comprising a swivel-type fastener for securing said first end of said plumb line to said plumb bob, said swivel-type fastener permitting said plumb bob to rotate relative to said plumb line to prevent said plumb line from twisting.

9. A golfer's aid as claimed in claim 3 further comprising securing collar means slidably mounted on said plumb line for securing said first end of said plumb line to said knob, said securing collar means securing said first end to said knob by abutting up against said knob after said second looped end has been looped over said knob and after said securing collar means has been slid over said second looped end to abut up against said knob.

10. A method of assembling a golfer's aid comprising:

providing a plumb bob;

providing a plumb line having a first end and a second end;

providing a cylindrical shaft having a first end for gripping, a second end and plumb line securing means attached to the midsection of the shaft for securing the second end of the plumb line to the shaft;

providing a first hemispherical half of a generally hollow, spherical casing having an interior surface and a dimpled exterior surface wherein the dimples are sized and configured to create the appearance of a golf ball, the first hemispherical half including first securing means and a first chamber portion, the first chamber portion defining part of a chamber for housing the plumb bob, part of an inner bore for receiving the plumb line, and part of an outer bore extending through the casing for permitting the passage of the plumb bob into and out of the chamber, the first hemispherical half also defining a round hole extending through the casing for receiving the first end of the shaft and for permitting the shaft to rotate therein;

providing a second hemispherical half of the generally hollow, spherical casing, the second hemispherical half including second securing means for cooperation with the first securing means of the first hemispherical half to secure the first and second hemispherical halves together so that the secured halves form the spherical casing, the second hemispherical half including a second chamber portion which defines the remaining portion of the chamber, the inner bore and the outer bore, the second hemispherical half also having a shaft retaining ring located on its interior surface for receiving the second end of the shaft and for permitting the second end to rotate therein, the shaft retaining ring being located on the second hemispherical shaft so as to generally oppose the round hole extending through the first hemispherical half so that longitudinal axis of the shaft is aligned with the axis of the casing when the shaft is mounted in the casing, the shaft further including a retaining collar mounted on the shaft at a location adjacent the first end of the shaft for abutting up against the portion of the interior surface of the second hemispherical half which surrounds the round hole, the retaining collar maintaining the shaft in axial alignment with the casing by preventing the second end of the shaft from slipping out of the retaining ring;

attaching the first end of the plumb line to the plumb bob;

attaching the second end of the plumb line to the plumb line securing means of the cylindrical shaft;

inserting the first end of the cylindrical shaft into the round hole of the first hemispherical half so that the retaining collar of the shaft abuts up against the portion of the interior surface of the second hemispherical shaft which surrounds the round hole;

inserting the second end of the cylindrical shaft into the shaft retaining ring of the second hemispherical half;

after said steps of inserting, arranging the plumb line so that the plumb line is located in those portions of the first or second chamber portions which define the inner bore and the outer bore;

pressing the first and second hemispherical halves together so that the first and second securing means of the first and second hemispherical halves snap together to secure the halves together to form the spherical casing; and rotating the cylindrical shaft to wind the plumb line about the shaft until the plumb bob is located in the chamber.

* * * * *